US007883342B2

(12) United States Patent
Yoshida et al.

(10) Patent No.: US 7,883,342 B2
(45) Date of Patent: Feb. 8, 2011

(54) ELECTRIC JUNCTION BOX

(75) Inventors: Masaoki Yoshida, Shizuoka (JP); Takuya Nakayama, Shizuoka (JP); Koji Ueyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 48 days.

(21) Appl. No.: 12/153,261

(22) Filed: May 15, 2008

(65) Prior Publication Data

US 2008/0299799 A1 Dec. 4, 2008

(30) Foreign Application Priority Data

May 28, 2007 (JP) ..... 2007-140329

(51) Int. Cl.
*H01R 12/00* (2006.01)

(52) U.S. Cl. ..... 439/76.2; 439/205

(58) Field of Classification Search ..... 439/76.2, 439/190, 205

See application file for complete search history.

(56) References Cited

U.S. PATENT DOCUMENTS 4,954,085 A * 9/1990 Inoue et al. ..... 439/34
4,963,099 A * 10/1990 Sato et al. ..... 439/76.2
6,796,809 B2 * 9/2004 Kakuta et al. ..... 439/76.2
6,870,096 B2 * 3/2005 Suzuki et al. ..... 174/50

FOREIGN PATENT DOCUMENTS

| | | |
|---|---|---|
| JP | 2000-102138 | 4/2000 |
| JP | 2002-152943 | 5/2002 |
| JP | 2003-348732 | 12/2003 |
| JP | 2004-328842 | 11/2004 |

* cited by examiner

*Primary Examiner*—Tho D Ta
*Assistant Examiner*—Travis Chambers
(74) *Attorney, Agent, or Firm*—Edwards Angell Palmer & Dodge LLP

(57) ABSTRACT

An electric junction box which includes: a wiring board; a connector block having a body part and terminals, the terminal penetrating through a bottom wall of the body part and one end part of the terminal being electrically connected to the wiring board; a case which is arranged above the bottom wall of the body part, has holes each of which allows an opposite end part of the terminal to pass therethrough so as to expose the terminal, and receives the wiring board and the connector block therein; and a drain part provided on an inner surface of the case so that water, which enters into the case from the hole and is drained from the connector block, moves downward along the inner surface of the case and is drained outside the case.

5 Claims, 8 Drawing Sheets

ELECTRIC JUNCTION BOX

CROSS REFERENCE TO RELATED APPLICATIONS

This application is related to two applications: "ELECTRICAL JUNCTION BOX" filed even date herewith in the names of Masaoki YOSHIDA, Takuya NAKAYAMA and Koji UEYAMA, which claims priority under 35 U.S.C. §1.119 to Japanese Patent Application No. 2007-140327; and "ELECTRICAL JUNCTION BOX" filed even date herewith in the names of Masaoki YOSHIDA, Takuya NAKAYAMA and Koji UEYAMA, which claims priority under 35 U.S.C. §1.119 to Japanese Patent Application No. 2007-140328, and which applications are assigned to the assignee of the present application and are incorporated by reference herein.

BACKGROUND OF THE INVENTION (1) Field of the Invention

The present invention relates to an electric junction box, which is mounted on a motor vehicle as a mobile unit and includes draining means for draining water which ?? entered the interior of the box.

(2) Description of the Related Art

In general, a motor vehicle as a mobile unit mounts various electronic instruments, for example, lamps such as a head lamp and tail lamp, motors such as a starter motor and air conditioner motor and so on. In order to supply electric power to such electronic instruments, the motor vehicle mounts junction blocks at suitable positions. The junction block is constructed by collecting various electric circuit units such as fuses, relays and so on.

The junction block may be called a fuse block, relay box or electric junction box as a general term because the junction block may include fuses, relays, busbars and so on. In this specification, such a fuse block, relay box or junction block is called an electric junction box as a general term.

For example, an electric junction box includes: a wiring board on which electric components are mounted; a connector block having a body part and terminals, which terminals penetrate through a bottom wall of the body part and one end part of each of which terminals is electrically connected to the wiring board; and a case which is arranged above the bottom wall of the body part and which has holes each of which allows an opposite end part of the terminal to pass therethrough so as to expose the terminal, and which receives the wiring board and the connector block therein.

For example, a fuse is attached to the terminal exposed from the hole. Because the fuse can be mounted or removed from the outside of the case, maintenance work can be easily carried out. However, on the other hand, water might enter the case through the hole when maintenance work is performed, resulting in the situation such that water might adhere on the wiring board received in the case and on the electric components mounted on the wiring board, possibly causing the electric junction box to be damaged as a result of a short circuit or corrosion of the wiring board.

In order to solve the above problems, the following electric junction box has been proposed (for example, see Japanese Patent Application laid-Open No. 2003-348732). Such an electric junction box has a body part of a connector block, which includes a groove formed on an inner surface (bottom surface) of a bottom wall and a drain outlet continuing to an end of the groove. Further, a case has a tube-shaped duct extending in an upward and downward direction of the case. The duct is arranged in the case, wherein an upper opening of the duct is arranged below and spaced from an end of the drain outlet while a lower opening of the duct is opened toward the lower side of the case.

Water which enters into the case through the hole reaches the bottom surface of the connector block, is absorbed in the groove, and is drained to the outside of the connector block from the drain outlet. Thereafter, the water falls into the duct from the drain outlet, passes through the duct, and is drained to the outside of the case.

In the electric junction box disclosed in Japanese Patent Application laid-Open No. 2003-348732, the drain outlet and the upper opening of the duct are arranged to be spaced apart from each other and the drained water falls into the duct from the drain outlet. Accordingly, when the electric junction box is actually mounted on a motor vehicle, depending on vibration and vehicle angle during traveling, the water from the drain outlet might fall outside the duct or the water might collide against an inner surface of the duct so that the water scatters outside the duct. Then, such water might adhere on the wiring board or on the electric components mounted on the wiring board, causing the electric junction box to be damaged due to a short circuit or corrosion of the wiring board. Moreover, the duct provided in the case brings about a problem that a structure of the electric junction box becomes complicated and a size of the electric junction box becomes large.

SUMMARY OF THE INVENTION

It is therefore an objective of the present invention to solve the above problems and to provide an electric junction box, by which the water entered in the case can be drained to a desired path with a simple structure so as to prevent the electric junction box from being damaged due to water entered into the wiring board and so on.

In order to attain the above objective, the present invention is to provide an electric junction box including:

a wiring board;

a connector block having a body part and terminals, the terminal penetrating through a bottom wall of the body part and one end part of the terminal being electrically connected to the wiring board;

a case which is arranged above the bottom wall of the body part, has holes each of which allows an opposite end part of the terminal to pass therethrough so as to expose the terminal, and receives the wiring board and the connector block therein; and a drain part provided on an inner surface of the case so that water, which enters into the case from the hole and is drained from the connector block, moves downward along the inner surface of the case and is drained outside the case.

With the construction described above, the water from the connector block moves down on a surface of the drain part along the drain part so as to be drained outside the case. Accordingly, the water which enters in the case can be drained without scattering to portions of the wiring board and the electric junction box can be prevented from being damaged due to the entered water.

The wiring board is arranged in a vertical direction in the case and the drain part is provided at least in a range of from above an upper end of the wiring board to below a lower end of the wiring board.

With the construction described above, the water from the connector block securely moves down on a surface of the drain part along the drain part in a height range of from the upper end to the lower end of the wiring board so as to be drained outside the case. Accordingly, the wiring board can be securely prevented from being affected by the entered water.

The drain part is a first rib projecting from the inner surface of the case.

With the construction described above, the water from the connector block moves down on a surface of the first rib along the first rib so as to be drained outside the case. Accordingly, the drain part can be made with a simple structure and the electric junction box can be made small.

A plurality of the first ribs are provided in the electric junction box.

With the construction described above, the water from the connector block securely moves down on surfaces of the first ribs along the first ribs so as to be drained outside the case. Accordingly, the water to be drained can be securely prevented from scattering.

A second rib is provided in the proximity of an upper end part of the first rib, the upper end part facing the connector block.

With the construction described above, a surface area of the drain part facing the connector block is increased with the aid of the second rib and the water from the connector block is positively adsorbed by the first and second ribs with a large surface tension. Moreover, because the second rib is provided only in the proximity of the upper end of the first rib, therefore the surface tension of the adsorbed water in a place, where the second rib does not exist, is decreased so that the water smoothly moves down along the first rib so as to be drained outside the case. Accordingly, the water entered in the case can be securely drained outside the case.

The drain part is a groove denting from the inner surface of the case.

With the construction described above, the water from the connector block moves down on an inner surface of the groove along the groove so as to be drained outside the case. Accordingly, the drain part can be made with a simple structure and the electric junction box can be made small.

DESCRIPTION OF EXEMPLARY EMBODIMENTS

In the following, an electric junction box 1 according to the first exemplary embodiment of the present invention will be explained with reference to FIGS. 1-6. The electric junction box 1 according to the first exemplary embodiment is received, for example, in another electric junction box so as to be mounted on a motor vehicle. The electric junction box 1 is supplied with electric power from a battery or the like, wherein the electric power is outputted to various electronic instruments through electric components such as a relay 11 and fuse.

Figure 5:
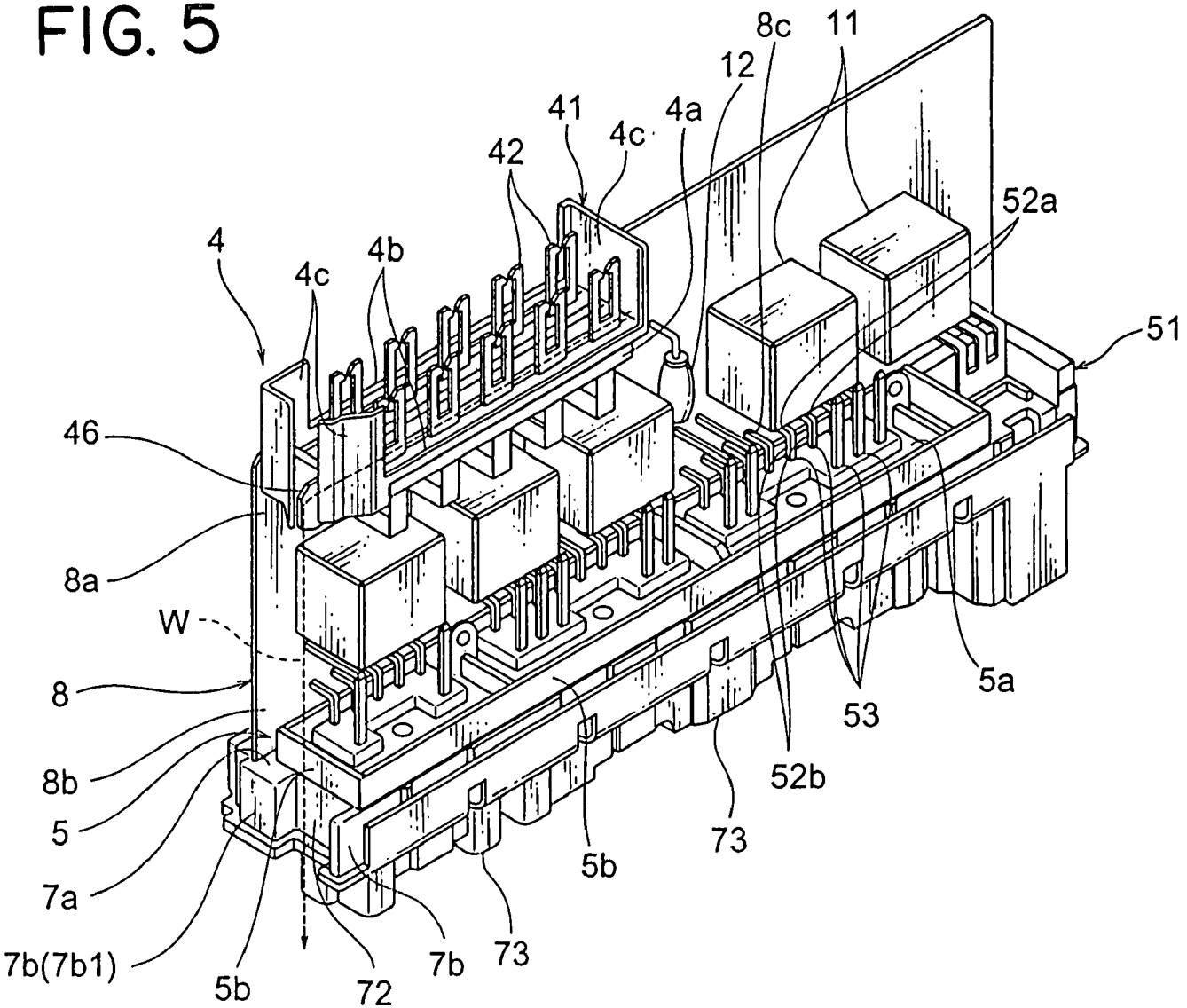
FIG. 5 is a perspective view illustrating a state when the upper case of the electric junction box shown in FIG. 1 is taken off.

The electric junction box 1 includes a printed circuit board assembly (PCB assembly) 2 and a case 3 receiving the PCB assembly 2 therein. As shown in FIG. 5, the PCB assembly 2 includes a board part 8 as the wiring board, a relay 11 and resistance 12 to be mounted on the board part 8, and connector blocks 4 and 5 to be attached to the board part 8.

The board part 8 is formed in a flat plate-shape and is formed in a rectangular shape in a plan view. The board part 8 includes a pair of printed wiring boards and an electrically conductive plate arranged between the pair of printed wiring boards, wherein the printed wiring boards and the conductive plate are placed on one another and formed in one piece. One of the pair of printed wiring boards has the same construction as that of another of the pair of printed wiring boards.

The printed wiring board includes an electrically insulating board, an electrical conductor pattern which is provided on a surface of the insulating board and forms a predetermined electric circuit, and a through hole 8*c* (see FIG. 3) penetrating through the insulating board.

The insulating board is made of electrically insulating synthetic resin or the like. The insulating board is formed in a flat plate-shape and formed in a rectangular shape in a plan view. The conductor pattern is made of metal such as copper, formed in a thin film-shape, and adheres on a surface of the insulating board. In the preferred embodiment, the conductor pattern is formed in a rectangular shape in a plan view.

A plurality of the through holes 8*c* are formed in a round shape in a plan view. The through hole 8*c* penetrates through the insulating board and also penetrates through a conductor plate to be placed on the printed wiring board and an insulating board of the other printed wiring board. A terminal of the relay 11, lead of the resistance 12, and board connecting pieces 42*a* and 52*a* of a fuse terminal 42 and connecting terminal 52 (explained later) are inserted into the through hole 8*c*. The entire inner surface of the through hole 8*c* is provided with a plating layer by copper plating. A surface of the insulating board 8 around the through hole 8*c* is provided with a plating layer (and a conductor pattern) and an electrically connected ring-shaped land, wherein the terminal of the relay 11, lead of the resistance 12, and board connecting pieces 42*a* and 52*a* are plated on the land.

The conductor plate is made of metal such as copper. The conductor plate is formed in a flat plate-shape and formed in a rectangular shape in a plan view. The plan view shape of the conductor plate is formed approximately equal to that of the insulating board of the pair of the printed wiring boards. The conductor plate forms a predetermined circuit by being divided into plural. The conductor plate is electrically connected to the land of the corresponding printed wiring board, i.e. the conductor pattern by the plating layer formed in the through hole 8*c*.

As shown in FIG. 5, the connector blocks 4 and 5 are arranged at an upper end 8*a* and lower end 8*b* of the board part 8 so as to be fixed to the board part 8. The connector block 4 corresponds to the connecter block described in the claims.

As shown in FIG. 5, the connector block 4 is formed having approximately the same length as that from one end to the center in the longitudinal direction of the board part 8 and arranged on the side of one end in the longitudinal direction of the board part 8. The connector block 4 includes a block body 41 as the body part and fuse terminals 42 as the terminals.

The block body 41 is made of electrically insulating synthetic resin or the like. The block body 41 includes a bottom wall 4*a* formed in a rectangular shape in a plan view, frame wall 4*b* rising up from the peripheral edge of the bottom wall 4*a*, and rising-up wall 4*c* rising up from both ends in the longitudinal direction of the bottom wall 4*a*. A projecting length of the rising-up wall 4*c* from the bottom wall 4*a* is larger than that of the frame wall 4*b*.

Figure 3:
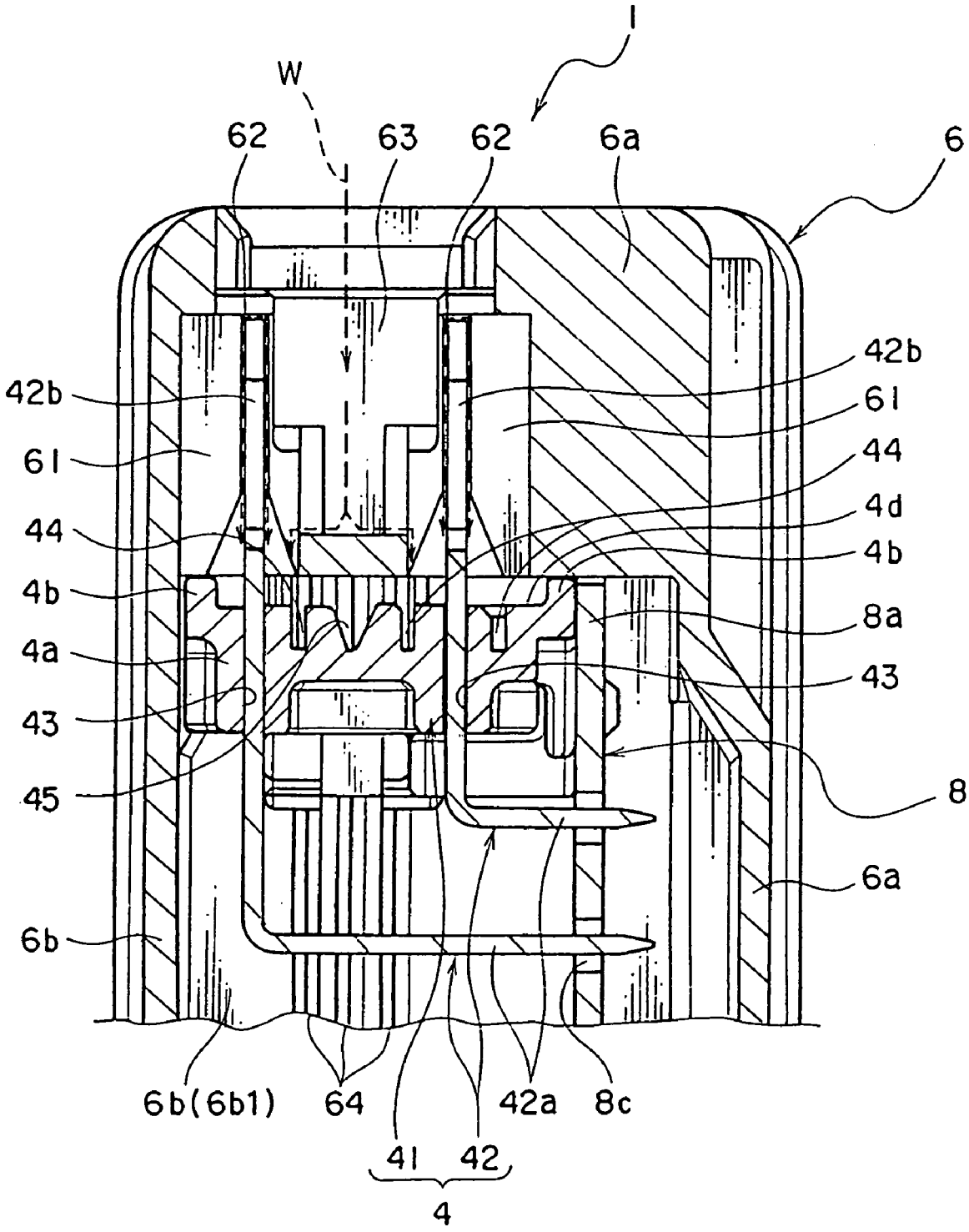
FIG. 3 is a cross sectional view taken along a III-III line in FIG. 1.

As shown in FIG. 3, the block body 41 includes a terminal press-fitting part 43 penetrating through the bottom wall 4*a*, a groove 44 and a V-shaped groove 45 formed on a bottom surface 4*d* as the inner surface of the bottom wall 4*a*, and a drain outlet 46 (see FIG. 5) continuing to an end of the groove 44 and of the V-shaped groove 45.

The terminal press-fitting part 43 is formed in a rectangular shape in a plan view. The longitudinal direction of the terminal press-fitting part 43 is parallel to that of the bottom wall 4*a*. A plurality of the terminal press-fitting parts 43 are provided and arranged lined up in two rows along the longitudinal direction of the bottom wall 4*a*. A fuse connecting piece 42*b* (explained later) of the fuse terminal 42 is press-fit into the terminal press-fitting part 43 and is supported by the terminal press-fitting part 43 in a liquid-tight manner.

The groove 44 is formed by denting from the bottom surface 4*d* and formed in a C-shape in a section. The groove 44 is formed along the row of the terminal press-fitting part 43 having approximately the same length as that of the row. A width of the groove 44 is formed constant and a bottom surface of the groove 44 is formed inclined downward (downward in FIG. 2) as approaching the drain outlet 46. Three grooves 44 are provided, that is, two grooves 44a between the pair of the terminal press-fitting parts 43 and one groove 44b between the row of one terminal press-fitting part 43 and an end part of the bottom wall 4*a*. The three grooves 44 are formed in parallel to one another. The groove 44*b* is arranged near the board part 8. One end of the groove 44*b* near the drain outlet 46 is bent in a right angle direction and continues to the groove 44*a* near the board part 8.

The groove 44 is formed having a narrow width so as to generate a capillary action in which the groove 44 absorbs water, which enters into the case 3 from a terminal hole 62 of an upper case 6 (explained later) and reaches the bottom surface 4*d* of the connector block 4, and guides the water to the drain outlet 46. The width of the groove 44 is set according to a length, width or depth, up to which the water is required to reach. As an example, it was confirmed that the capillary action was generated when the width of the groove 44 was set to be 0.5 mm.

The V-shaped groove 45 is formed by denting from the bottom surface 4*d* and formed in a V-shape in a section. The V-shaped groove 45 is provided between the grooves 44 and formed along the groove 44 having approximately the same length as that of the groove 44. A width of the V-shaped groove 45 is formed constant and a bottom surface of the V-shaped groove 45 is formed inclined downward as approaching the drain outlet 46.

The drain outlet 46 is formed in a notch-shape by notching the rising-up wall 4*c* in a direction approaching the bottom wall 4*a* from an upper end of the rising-up wall 4*c*. An end of the groove 44 and the V-shape groove 45, situated on the side at which the bottom surface is inclined downward, is positioned at the drain outlet 46. The drain outlet 46 drains the water, which passes through the groove 44 and the V-shaped groove 45 and flows into the drain outlet 46, from the connector block 4.

The fuse terminal 42 is formed by bending a press-processed sheet metal. A plurality of the fuse terminals 42 are provided. As shown in FIG. 3, the fuse terminal 42 is formed in an L-shape in section and includes: the board connecting piece 42*a* as the one end part; and the fuse connecting piece 42*b* as the opposite end part crossing the board connecting piece 42*a* at right angles. The board connecting piece 42*a* is inserted into the through hole 8*c* in a direction crossing the board part 8 at right angles and penetrates through the board part 8, so that an end of the board connecting piece 42*a* is electrically connected to the board part 8. The fuse connecting piece 42*b* is press-fit into the terminal press-fitting part 43 of the block body 41 and penetrates through the bottom wall 4*a*, so that an end of the fuse connecting piece 42*b* is electrically connected to the fuse.

The board connecting piece 42*a* of the fuse terminal 42 is inserted into the through hole 8*c* and the connector block 4 is screwed in such a manner that the bottom wall 4*a* crosses the board part 8 at right angles and becomes parallel to the longitudinal direction of the board part 8, so that the connector block 4 is fixed to the board part 8. The groove 44 and the V-shaped groove 45 are arranged in parallel to the longitudinal direction of the board part 8. The bottom walls of the groove 44 and the V-shaped groove 45 are arranged inclined downward from the horizontal direction. The fuse connecting piece 42*b* is arranged so as to project from an upper end 8*a* of the board part 8 (i.e. in a direction crossing the width direction of the board part 8 at right angles) and inserted into a terminal hole 62 of an upper case 6 (explained later).

When the water which has entered the case 3 reaches the bottom surface 4*d* of the connector block 4, the water is absorbed by the groove 44 and the V-shaped groove 45. The water, which is difficult to be absorbed by the V-shaped groove 45 due to surface tension, is positively absorbed by the groove 44. Then, the water is guided to the drain outlet 46 by the inclined bottom surfaces of the groove 44 and the V-shaped groove 45.

As shown in FIG. 5, the connector block 5 has approximately the same length as that of the board part 8 in the longitudinal direction thereof. The connector block 45 includes a block body 51 and connection terminals 52.

The block body 51 is made of electrically insulating synthetic resin or the like. The block body 51 includes a bottom wall 5*a* formed in a rectangular shape in a plan view, a frame wall 5*b* rising up from the peripheral edge of the bottom wall 5*a*, and terminal press-fitting parts 53.

The terminal press-fitting part 53 is formed in a square shape in a plan view. A plurality of the terminal press-fitting parts 53 are arranged lined up in two rows along the longitudinal direction of the bottom wall 5*a*. An external connecting piece 52*b* (explained later) of the connecting terminal 52 is press-fit into the terminal press-fitting part 53, so that the external connecting piece 52*b* is supported by the terminal press-fitting part 53 in a liquid-tight manner.

The connecting terminal 52 is formed by bending a metal rod. A plurality of the connecting terminals 52 are provided. The connecting terminal 52 is formed in a L-shape and includes a board connecting piece 52*a* and an external connecting piece 52*b* crossing the board connecting piece 52*a* at right angles. The board connecting piece 52*a* is inserted into the through hole 8*c* in a direction crossing the board part 8 at right angles so as to penetrate through the board part 8, so that an end of the board connecting piece 52*a* is electrically connected to the board part 8. The external connecting piece 52*b* is press-fit into the terminal press-fitting part 53 of the block body 51 and penetrates through the bottom wall 5*a*, so that an end of the external connecting piece 52*b* is electrically connected to a terminal fitting of a connector of a wiring harness.

The board connecting piece 52*a* of the connecting terminal 52 is inserted into the through hole 8*c* of the board part 8 and the connector block 5 is screwed in such a manner that the bottom wall 5*a* crosses the board part 8 at right angles and becomes parallel to the longitudinal direction of the board part 8, so that the connector block 5 is fixed to the board part 8. The external connecting piece 52*b* is arranged so as to project from a lower end 8*b* of the board part 8 (i.e. in a direction crossing the width direction of the board part 8 at right angles) and is inserted into a terminal hole of a lower case 7 (explained later) so as to be exposed to the outside.

The case 3 includes an upper case 6 (see FIG. 4), lower case 7 (see FIG. 5), rib 64 (i.e. the first rib) as the drain part provided on an inner surface of the case 3, and dented groove 72 receiving the rib 64.

The upper case 6 includes an upper wall 6*a* formed in a rectangular shape in a plan view and a peripheral wall 6*b* continuing to the peripheral edge of the upper wall 6*a* and formed in a flat box-shape. As shown in FIG. 3, the upper wall 6*a* includes a terminal receiving part 61 provided on the inner surface of the upper wall 6*a*, terminal hole 62 as a hole penetrating through the upper wall 6*a*, and fuse attaching part 63 provided on an outer surface of the upper wall 6*a*.

The terminal receiving part 61 is formed projecting from the inner surface of the upper wall 6*a*. A terminal hole 62 is formed inside the terminal receiving part 61, which receives and holds the fuse connecting piece 42*b* inserted in the terminal hole 62.

The terminal hole 62 is formed in a rectangular shape in a plan view. The longitudinal direction of the terminal hole 62 is parallel to that of the upper wall 6*a*. A plurality of the terminal holes 62 are provided, arranged lined up in two rows along the longitudinal direction of the upper wall 6*a*, and arranged facing each other along the width direction of the upper wall 6*a*. When the upper case 6 is attached to the PCB assembly 2, the terminal hole 62 is arranged above the bottom wall 4*a* of the connector block 4 and exposes the fuse connecting piece 42*b* through the fuse connecting piece 42*b* penetrating through the bottom wall 4*a*. The terminal hole 62 is formed a little larger than the fuse connecting piece 42*b*. The water enters into the case 3 through a gap formed between the fuse connecting piece 42*b* and the terminal hole 62.

A plurality of the fuse attaching parts 63 are formed denting from an outer surface of the upper wall 6*a*. One fuse attaching part 63 is provided per a pair of the terminal holes 62 facing each other along the width direction of the upper wall 6*a*. One fuse attaching part 63 attaches one fuse. The fuse connecting piece 42*b* passing through the pair of the terminal holes 62 is electrically connected to one fuse.

As shown in FIG. 5, the lower case 7 is formed in a box-shape and includes a bottom wall 7*a* formed in a rectangular shape in a plan view and a peripheral wall 7*b* continuing to a peripheral edge of the bottom wall 7*a*.

The bottom wall 7*a* includes a terminal hole penetrating through the bottom wall 7*a* and a connector hood 73. The terminal hole is formed in a square shape in a plan view. A plurality of the terminal holes are provided, arranged lined up in two rows along the longitudinal direction of the bottom wall 7*a*. The terminal hole exposes the external connecting piece 52*b* to the outside through the external connecting piece 52*b* of the connecting terminal 52, which penetrates through the bottom wall 5*a* of the connector block 5. The terminal hole is formed a little larger than the external connecting piece 52*b*.

A plurality of the connector hoods 73 are lined up along the longitudinal direction of the bottom wall 7*a*. The connector hoods 73 is formed in a hood-shape and projects toward the lower side (lower side in FIG. 5) of the case 3. The external connecting piece 52*b* of the connecting terminal 52, which is inserted in the terminal hole of the bottom wall 7*a*, projects within the connector hood 73. The connector hood 73 attaches a connector of a wiring harness from the lower side of the case 3. The connecting terminal 52 is electrically connected to the outside through a terminal fitting of the connector.

Figure 4:
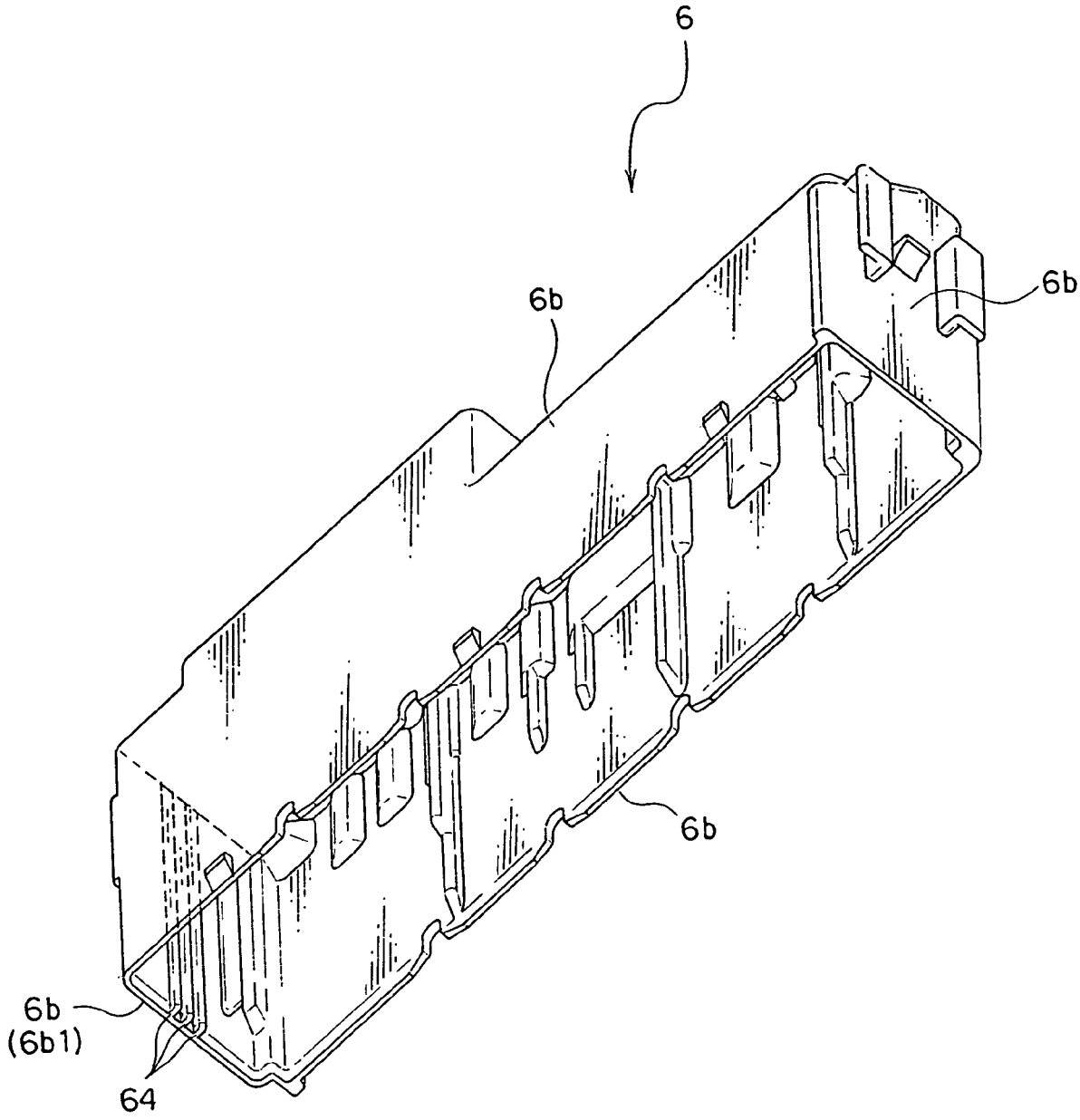
FIG. 4 is a perspective view of an upper case of the electric junction box shown in FIG. 1.
Figure 6:
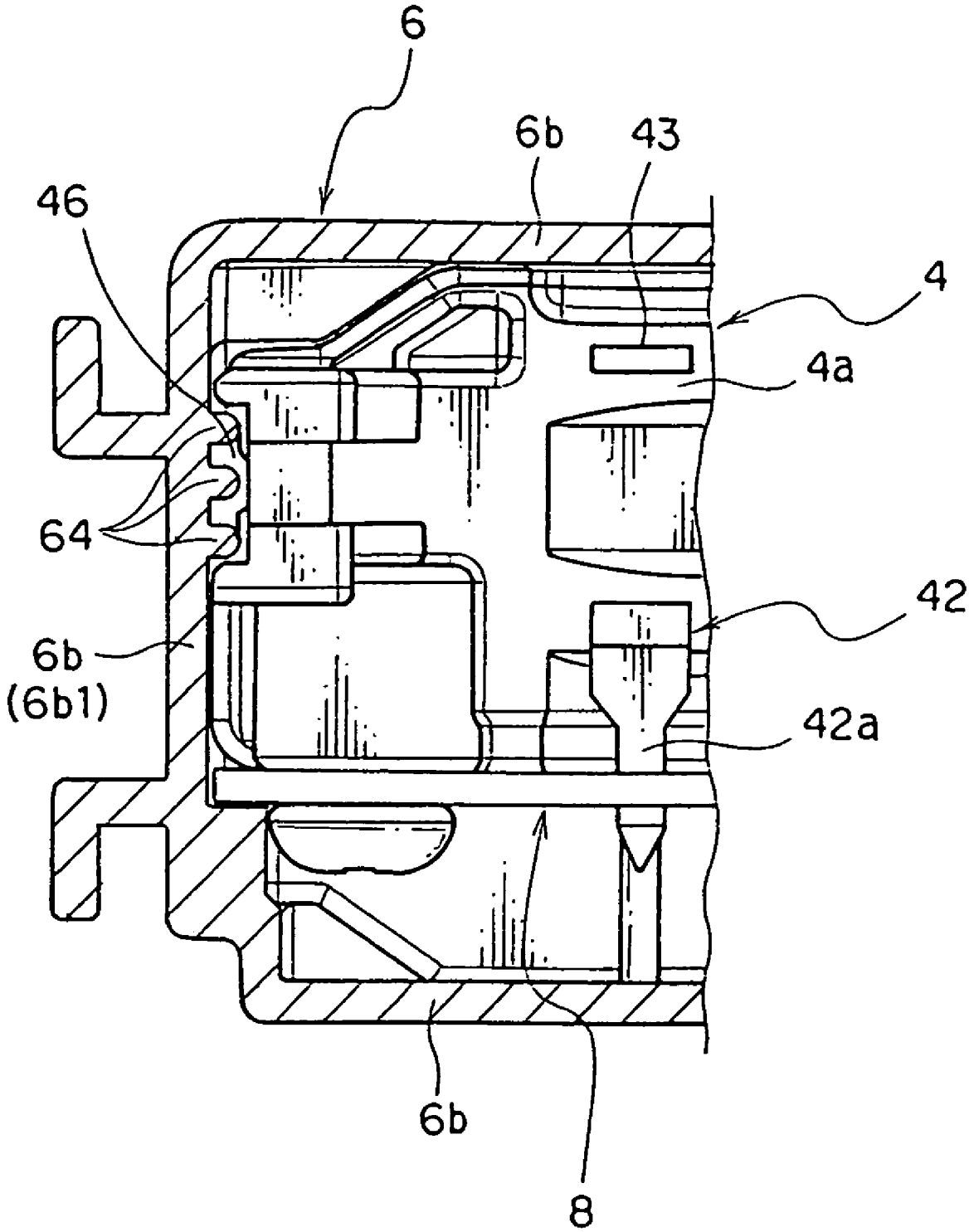
FIG. 6 is a cross sectional view viewed from a direction of an arrow VI in FIG. 2.

As shown in FIGS. 3, 4 and 6, the rib 64 is provided on one peripheral wall 6*b*1 continuing to an end of the longitudinal direction of the upper wall 6*a* and formed projecting from an inner surface of the peripheral wall 6*b*1. The rib 64 extends in a direction crossing the upper wall 6*a* at right angles and formed in the longitudinal direction of the entire peripheral wall 6*b*1. Therefore, when the upper case 6 is attached to the PCB assembly 2, the rib 64 is arranged in a range from above the upper end 8*a* of the board part 8 arranged in the vertical direction to below the lower end 8*b* of the board part 8. At that time, the rib 64 is arranged facing the drain outlet 64 of the connector block 4 having a little distance from the drain outlet 64.

A plurality of the ribs 64 are provided and arranged in parallel to each other. The water drained from the connector block 4 moves downward between a plurality of the ribs 64 (and on an outer surface of the rib 64) so as to be drained outside the case 3.

As shown in FIG. 5, the dented groove 72 is provided on a peripheral wall 7*b*1 facing a peripheral wall 6*b*1 of the upper case 6, on which the rib 64 is provided, and formed denting from an outer surface of the peripheral wall 7*b*1. The dented groove 72 extends in a direction crossing the bottom wall 7*a* at right angles (i.e. in a direction parallel to the rib 64 of the upper case 6). When the upper case 6 is attached to the lower case 7, a lower end of the rib 64 is received in the dented groove 72 being spaced from an inner surface of the dented groove 72, and the water, which moves downward along the rib 64, is drained outside the case 3 without flowing into the lower case 7.

The case 3 is assembled as follows and receives the PCB assembly 2 therein. First, the external connecting piece 52*b* of the PCB assembly 2 is inserted into the terminal hole of the lower case 7, so that the PCB assembly 2 is attached to the lower case 7 in such a manner that the board part 8 crosses the bottom wall 7*a* of the lower case 7 at right angles. Thereafter, the upper case 6 is attached from the upper side of the PCB assembly 2 and the fuse connecting piece 42*b* is inserted into the terminal hole 62 of the upper case 6. The upper case 6 is attached to the lower case 7 in such a manner that the peripheral wall 7*b* of the lower case 7 is placed on the peripheral wall 6*b* of the upper case 6.

When the electric junction box 1 is to be assembled, first, the relay 11 and resistance 12 are mounted on the board part 8, the block bodies 41, 51 of the connector blocks 4, 5 are screwed in the board part 8, and the fuse terminal 42 and the connecting terminal 52 are mounted on the board part 8, thereby assembling the PCB assembly 2. Thereafter, the PCB assembly 2 is attached to the lower case 7, and the upper case 6 is attached to the lower case 7, thereby assembling the electric junction box 1. A fuse is attached to the fuse attaching part 63 of the upper case 6 and a connector of a wiring harness is fit to the connector hood 73 of the lower case 7.

In the following, a drain path W (shown with a dotted arrow in FIGS. 2, 3 and 5) of water of the electric junction box 1 will be explained. For example, upon a maintenance work, water might splash on the electric junction box 1 from above the electric junction box 1 (from the upper side in FIGS. 2 and 5). As shown in FIG. 3, the water enters into the fuse attaching part 63 and enters into the case 3 from a gap between the terminal hole 62 and the fuse connecting piece 42*b*. Then, the water moves on a surface of the fuse connecting piece 42*b* and reaches the bottom surface 4*d* of the connector block 4.

Figure 1:
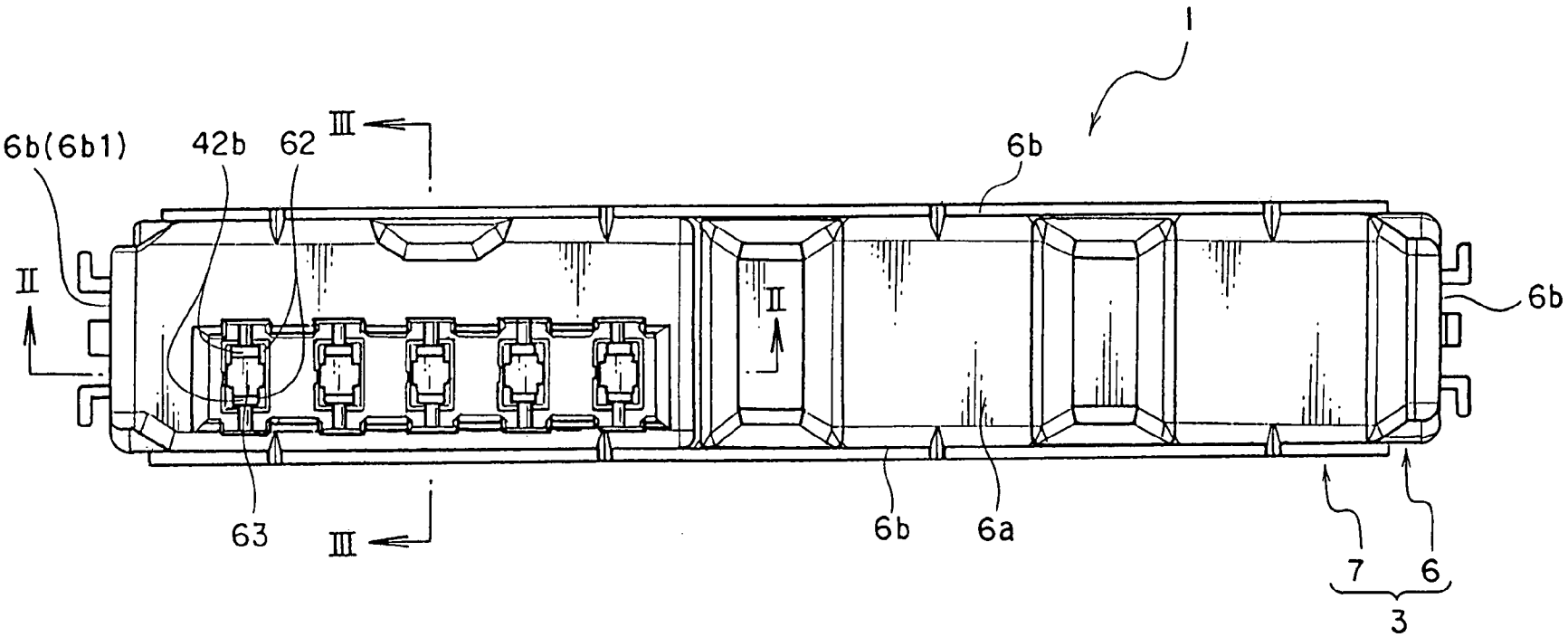
FIG. 1 is a top plan view illustrating an electric junction box according to the first preferred embodiment of the present invention.
Figure 2:
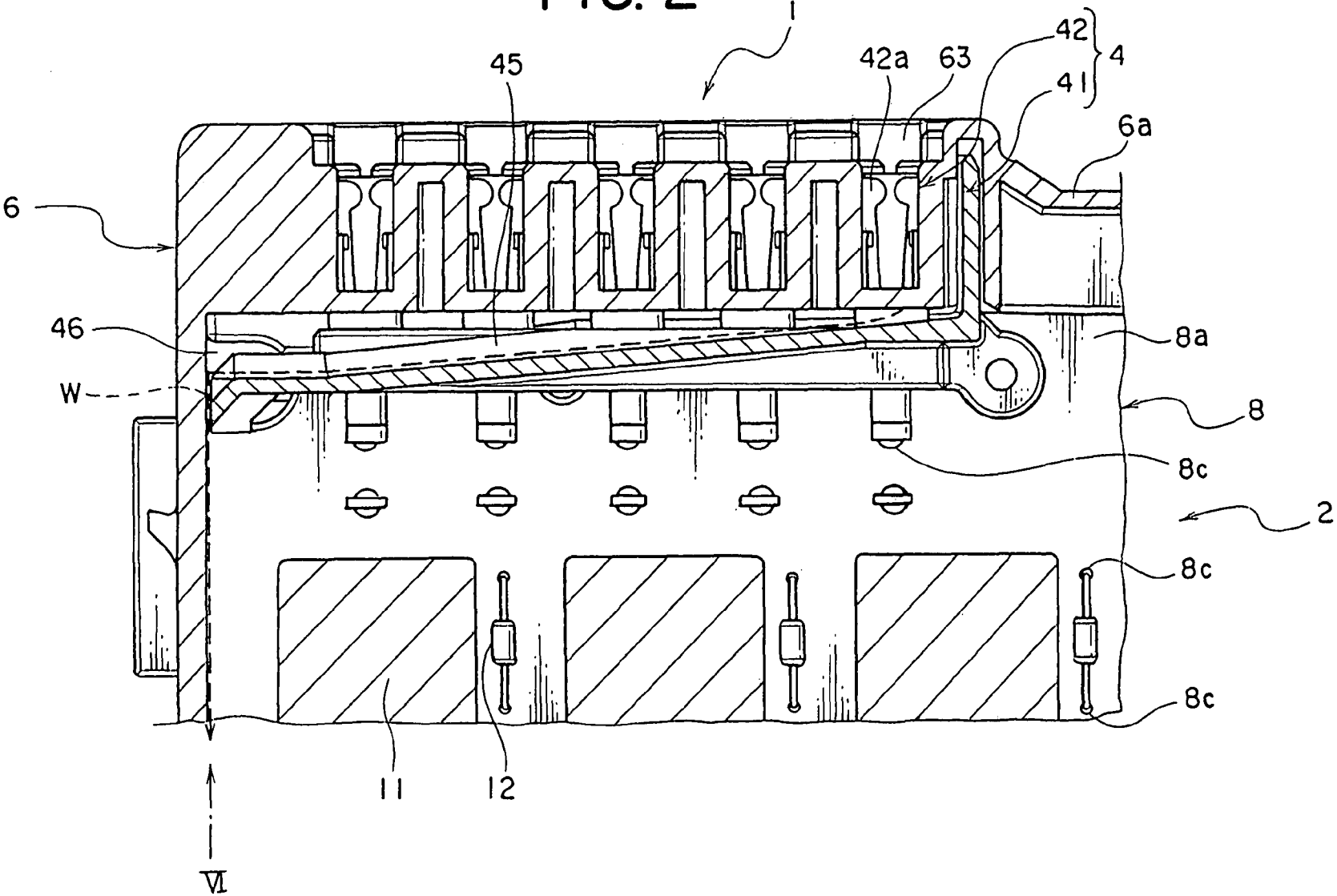
FIG. 2 is a cross sectional view taken along a II-II line in FIG. 1.

The water reached the bottom surface 4*d* is positively absorbed by the groove 44, which is formed so as to generate a capillary action, and also absorbed by the V-shaped groove 45. Then, as shown in FIGS. 2 and 5, the water is guided to the drain outlet 46 by a bottom surface inclined downward of the groove 44 and the V-shaped groove 45 and drained outside the case 3.

The water moves along a plurality of the ribs 64 arranged facing the drain outlet 46. The water from the drain outlet 46 is absorbed between the ribs 64 and moves downward between the ribs 64 (and moves downward along outer surfaces of the ribs 64), so that the water is drained outside the case 3.

According to the exemplary embodiment described above, the rib 64 is provided on an inner surface of the case 3 so that the water, which enters into the case 3 from the terminal hole 62 and drained from the connector block 4, is moved downward along the inner surface of the case 3 so as to be drained outside the case 3. Therefore, the water from the connector housing 4 moves downward along the outer surface of the rib 64 and is drained to the outside of the case 3. Accordingly, the water entered in the case 3 can be drained without scattering to a part such as the board part 8 and the electric junction box 1 can be prevented from being damaged due to the entered water.

The board part 8 is arranged in a vertical direction in the case 3 and the rib 64 is provided at least in a range of from above an upper end of the board part 8 to below a lower end of the board part 8. Therefore, the water from the connector block 4 securely moves down on a surface of the rib 64 along the rib 64 in a height range of from the upper end 8*a* to the lower end 8*b* of the board part 8 so as to be drained outside the case 3. Accordingly, the board part 8 can be securely prevented from being affected by the water entered.

Because the rib 64 projects from the inner surface of the case 3, therefore the water from the connector block 4 moves down on a surface of the rib 64 along the rib 64 so as to be drained outside the case 3. The rib 64 having a simple structure enables to securely drain the water and the electric junction box 1 can be made small.

Because a plurality of the ribs 64 are provided in the electric junction box 1, therefore the water from the connector block 4 securely moves down on surfaces of the ribs 64 along the ribs 64 so as to be drained outside the case 3. Accordingly, the water to be drained can be securely prevented from scattering.

Figure 7:
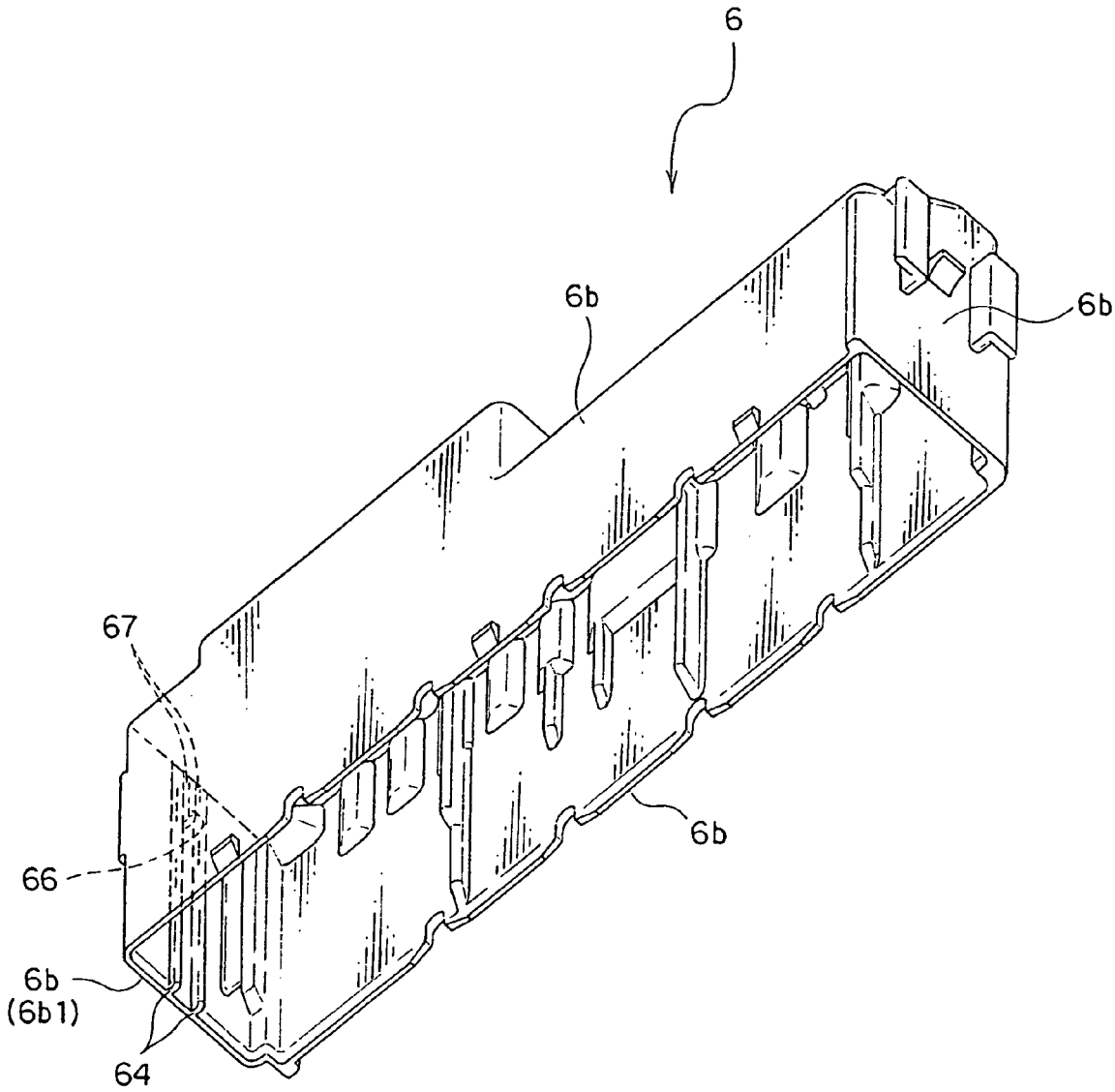
FIG. 7 is a perspective view illustrating an upper case of an electric junction box according to the second preferred embodiment of the present invention.

In the following, an electric junction box 1 according to the second exemplary embodiment of the present invention will be explained with reference to FIG. 7.

The electric junction box 1 according to the second exemplary embodiment includes a pair of ribs 64 (i.e. the first ribs) as the drain part. The pair of the ribs 64 is arranged in parallel to each other. A second rib 66 is provided in the proximity of an upper end part of the rib 64, the upper end part facing the connector block 4.

The second rib 66 projects from an inner surface of the peripheral wall 6*b*1 of the upper case 6. The second rib 66 is arranged in parallel to the pair of the ribs 64 having a distance from each rib 64. The second rib 66 faces each rib 64. The second rib 66 is shorter than the rib 64 and positioned facing the rib 64 in a range of from an upper end of the rib 64 to the lower part of the rib 64 situated lower than a part of the rib 64, which faces the bottom wall 4*a* of the connector block 4. A projecting length of the second rib 66 from the inner surface of the peripheral wall 6*b*1 is approximately the same as that of the rib 64 from the inner surface of the peripheral wall 6*b*1.

As a result of the second rib 66, the proximity of the upper end part of the pair of the ribs 64 has a large area. When the upper case 6 is attached to the PCB assembly 2, the end part of the pair of the ribs 64 is arranged facing the drain outlet 46 of the connector block 4 each other having a small distance therebetween. The water from the drain outlet 46 is positively adsorbed to the pair of the ribs 64 and the second rib 66. The adsorbed water moves downward along the pair of the ribs 64 and the second rib 66. Since the second rib 66 is provided in the proximity of the upper end part of the pair of the ribs 64 and is not provided on the lower end part thereof, therefore the adsorbed water smoothly moves downward between the pair of the ribs 64 (and on the outer surfaces of the ribs 64) in a range where the second rib 66 does not exist since the surface tension is small there, and is drained outside the case 3.

According to the second exemplary embodiment, because the second rib 66 is provided in the proximity of the upper end part of the rib 64, wherein the end part of the rib 64 is arranged facing the connector block 4, therefore the water from the connector block 4 is positively adsorbed to the ribs 64 and the second rib 66. Further, because the second rib 66 is provided only in the proximity of the upper end part of the rib 64, therefore the adsorbed water smoothly moves down along the ribs 64 in a range where the second rib 66 does not exist since the surface tension is small there, and is drained outside the case 3. Accordingly, the water entered into the case 3 can be further securely drained outside the case 3.

In the second exemplary embodiment, the second rib 66 is provided between the pair of the ribs 64. However, in the present invention, only one rib 64 may be provided or, alternatively, more than two ribs 64 may be provided.

Figure 8:
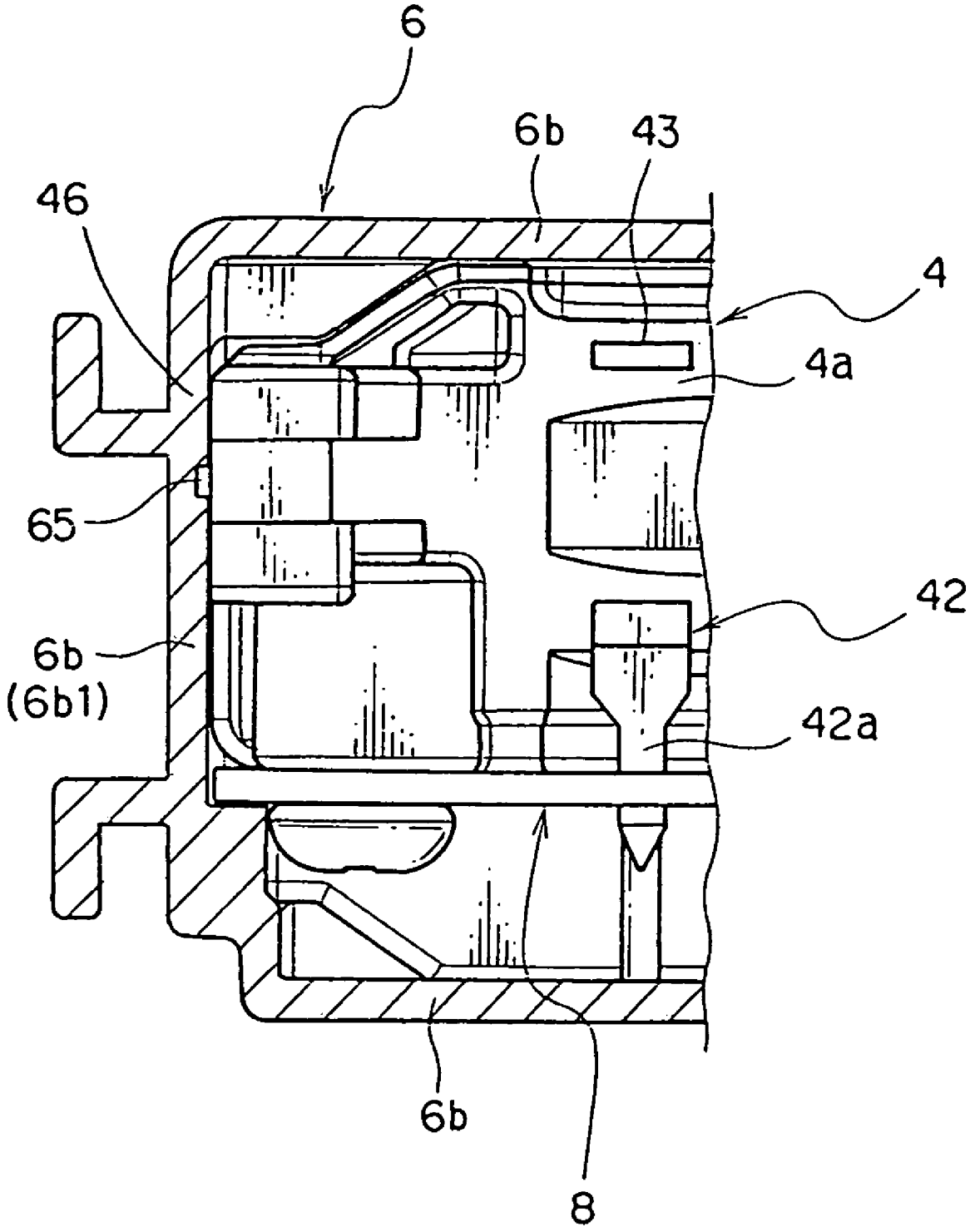
FIG. 8 is a cross sectional view illustrating an electric junction box according to the third preferred embodiment of the present invention.

In the following, an electric junction box 1 according to the third exemplary embodiment of the present invention will be explained with reference to FIG. 8.

A case 3 of the electric junction box 1 according to the third exemplary embodiment includes a groove 65 as the drain part. The groove 65 is provided on a peripheral wall 6*b*1 of the upper case 6 and formed denting from an inner surface of the peripheral wall 6*b*1. The groove 65 extends in a direction crossing the upper wall 6*a* of the upper case 6 at right angles and provided in the entire longitudinal direction of the peripheral wall 6*b*1. Therefore, when the upper case 6 is attached to the PCB assembly 2, the groove 65 is arranged in a range of from above an upper end 8*a* of the board part 8 arranged in the vertical direction to below a lower end 8*b* of the board part 8. At that time, the groove 65 is arranged facing the drain outlet 46 of the connector block 4 having a small distance from the drain outlet 46.

The water which has drained from the drain outlet 46 to the outside of the connector block 4 moves in the groove 65, flows on an inner surface of the groove 65, moves down along the groove 65 up to a lower end of the upper case 6, and is guided to the outside of the case 3. A plurality of the grooves 65 may be provided. A second rib 66 may be formed at an upper end part of the groove 65 facing the connector block 4 so that the water from the drain outlet 46 is positively absorbed by the groove 65 due to surface tension.

According to the third exemplary embodiment, the groove 65 is provided on an inner surface of the case 3 so that the water, which enters into the case 3 from the terminal hole 62 and drained from the connector block 4, is moved downward along the inner surface of the case 3 so as to be drained outside the case 3. Therefore, the water from the connector housing 4 moves downward along the inner surface of the groove 65 and is drained to the outside of the case 3. Accordingly, the water which has entered into the case 3 can be drained without scattering to a part such as the board part 8 and the electric junction box 1 can be prevented from being damaged due to the entered water.

The board part 8 is arranged in a vertical direction in the case 3 and the groove 65 is provided at least in a range of from above an upper end of the board part 8 to below a lower end of the board part 8. Therefore, the water from the connector block 4 securely moves down on an inner surface of the groove 65 along the groove 65 in a height range of from the upper end 8*a* to the lower end 8*b* of the board part 8 so as to be drained outside the case 3. Accordingly, the board part 8 can be securely prevented from being affected by the water entered.

Because the groove 65 is dented from the inner surface of the case 3, therefore the water from the connector block 4 moves down on the inner surface of the groove 65 along the groove 65 so as to be drained outside the case 3. The groove 65 having a simple structure enables to securely drain the water and the electric junction box 1 can be made small.

The aforementioned exemplary embodiments are described to aid in understanding the present invention and variations may be made by one skilled in the art without departing from the spirit and scope of the present invention.

What is claimed is:

1. An electric junction box comprising:

a wiring board;

a connector block having a body part and terminals, each said terminal penetrating through a bottom wall of the body part and one end part of the terminal being electrically connected to the wiring board, said body part having a drain outlet for draining water from the connector block;

a case which is arranged above the bottom wall of the body part, said case having holes, each of which allows an opposite end part of each said terminal to pass therethrough so as to expose each said terminal, and receives the wiring board and the connector block therein; and a drain part provided on an inner surface of the case, said drain part arranged facing the drain outlet of the connector block and being spaced a small distance from the drain outlet, wherein the wiring board is arranged in a vertical direction in the case, and wherein the drain part is provided at least in a range of from above an upper end of the wiring board to below a lower end of the wiring board, and wherein the water, which enters into the case from the holes and is drained from the drain outlet of the connector block, moves downward along the drain part provided on the inner surface of the case and is drained outside the case.

2. The electric junction box according to claim 1, wherein the drain part is a groove denting from the inner surface of the case.

3. The electric junction box according to claim 1, wherein the drain part is a first rib projecting from the inner surface of the case.

4. The electric junction box according to claim 3, wherein a plurality of the first ribs are provided.

5. The electric junction box according to claim 3, wherein a second rib is provided in a proximity of an upper end part of the first rib, the upper end part facing the connector block.

* * * * *